US007457427B2

(12) United States Patent
Birli et al.

(10) Patent No.: US 7,457,427 B2
(45) Date of Patent: Nov. 25, 2008

(54) DUAL MICROPHONE ASSEMBLY FOR MASK

(75) Inventors: Joseph Birli, Munson, OH (US); Greg Skillicorn, Grainger Township, OH (US)

(73) Assignee: Ultra Electronics Audiopack, Inc., Garfield Hts., OH (US)

( * ) Notice: Subject to any disclaimer, the term of this patent is extended or adjusted under 35 U.S.C. 154(b) by 679 days.

(21) Appl. No.: 10/667,995

(22) Filed: Sep. 22, 2003

(65) Prior Publication Data

US 2005/0063561 A1 Mar. 24, 2005

(51) Int. Cl.
*H04R 25/00* (2006.01)

(52) U.S. Cl. ..... 381/367; 381/376

(58) Field of Classification Search ..... 381/364, 381/367, 361, 376, 344, 380, 151, 184, 186; 128/201.22, 201.23, 201.24, 201.19, 201.27, 128/201.29, 201.11

See application file for complete search history.

(56) References Cited

U.S. PATENT DOCUMENTS 3,314,424 A * 4/1967 Berman ..... 128/201.19
4,123,622 A * 10/1978 MacLeod ..... 381/189
4,311,872 A 1/1982 Davis
4,475,232 A 10/1984 Shaw
4,718,415 A * 1/1988 Bolnberger et al. .... 128/201.19
4,736,740 A * 4/1988 Parker et al. ..... 128/201.19
4,757,553 A 7/1988 Crimmins
4,885,796 A 12/1989 Loftus et al.
4,901,356 A 2/1990 Bauer
5,138,666 A 8/1992 Bauer et al.
5,142,700 A * 8/1992 Reed ..... 455/344
5,224,473 A 7/1993 Bloomfield
5,224,474 A 7/1993 Bloomfield
5,371,804 A 12/1994 Bauer
5,428,688 A 6/1995 Becker et al.
5,463,693 A 10/1995 Birli et al.
5,566,362 A 10/1996 Bauer (Continued)

FOREIGN PATENT DOCUMENTS

WO WO 91/07859 5/1991

(Continued)

OTHER PUBLICATIONS

"Operating and Maintenance Instructions for Voice Amplifier/Radio Interface", ClearCommand Communications System, Amplifier P/N 10023056 and Amplifier RI P/N 10023057, 2000, p. 1-4.

(Continued)

*Primary Examiner*—Curtis Kuntz
*Assistant Examiner*—Phylesha L Dabney
(74) *Attorney, Agent, or Firm*—Fay Sharpe LLP; Brian E. Turung

(57) ABSTRACT

A microphone assembly including two microphones is usable in connection with a mask of the type worn by someone wearing a protective mask or respirator. The two microphones may share a common pass-through. The output signals of the two microphones may share one or more conductors in the pass-through. One microphone may support the other on the mask, or the microphones may be physically separate, or the microphones may be formed as one unit. The invention also relates to a mask having at least two microphones.

28 Claims, 4 Drawing Sheets

U.S. PATENT DOCUMENTS

| | | | | |
|---|---|---|---|---|
| 6,010,256 | A * | 1/2000 | Piccinino et al. | 396/612 |
| 6,075,857 | A * | 6/2000 | Doss et al. | 379/430 |
| 6,101,256 | A | 8/2000 | Steelman | |
| 6,978,034 | B2 * | 12/2005 | Lazzeroni et al. | 381/384 |
| 7,089,930 | B2 | 8/2006 | Adams | |
| 7,110,743 | B2 | 9/2006 | Depew et al. | |
| 7,221,966 | B2 | 5/2007 | Birli et al. | |
| 2002/0176595 | A1 * | 11/2002 | Lazzeroni et al. | 381/376 |
| 2003/0224838 | A1 | 12/2003 | Skillicorn et al. | |
| 2005/0063561 | A1 | 3/2005 | Birli et al. | |
| 2005/0201548 | A1 | 9/2005 | Birli et al. | |
| 2005/0213782 | A1 | 9/2005 | Miller et al. | |
| 2006/0050917 | A1 | 3/2006 | Skillicorn et al. | |
| 2006/0177084 | A1 | 8/2006 | Skillicorn et al. | |
| 2007/0049360 | A1 | 3/2007 | Birli et al. | |

FOREIGN PATENT DOCUMENTS

| | | |
|---|---|---|
| WO | WO 92/15369 | 9/1992 |
| WO | WO 95/30285 | 11/1995 |

OTHER PUBLICATIONS

"Installation Instructions for Bracket and Voicemitter Kit" , ClearCommand Communications System, Kit P/N 10023055, 2000, p. 1-4.

"BAcomm System Installation and Operating Instructions", Drager, Jun. 14, 2002, p. 1-2.

ClearCommand™ Communications System Operating and Maintenance instructions Voice Amplifier /radio Interface, Mine Safety Appliances Company, Pittsburgh, PA 15230, 2000.

ClearCommand™ Communications System Installation Instructions, Bracket and Voicemitter Kit, Mine Safety Appliances Company, Pittsburgh, PA 15230, 2000.

Dräger BAcomm System Installation & Operation Instructions, Jun. 14, 2002.

* cited by examiner

DUAL MICROPHONE ASSEMBLY FOR MASK

TECHNICAL FIELD

The present invention relates to a microphone assembly for a mask. In particular, the present invention relates to microphone usable in connection with a mask of the type worn by someone wearing a protective mask or respirator.

BACKGROUND OF THE INVENTION

Masks of various types are worn by people for different reasons. For example, some occupations require the wearing of a mask at least part of the time. A firefighter may wear a mask to enable breathing of fresh air or gases such as oxygen. A mask may be, or include, an air purifying respirator or an air supplied respirator.

When a mask is worn, the user's mouth and nose may be covered. This can make it harder for the user to communicate orally with others nearby. Therefore, some masks include a communication system, such as a voice amplification system or a radio interface system. Some of these systems use microphones and amplifiers to help the user to be heard clearly outside the user's mask, either directly at the location or remotely via radio frequency connection.

SUMMARY OF THE INVENTION

The present invention relates to a microphone assembly for a mask. In particular, the present invention relates to a microphone assembly including two microphones, usable in connection with a mask of the type worn by someone wearing a protective mask or respirator. The two microphones may share a common pass-through. The output signals of the two microphones may share one or more conductors in the pass-through. One microphone may support the other on the mask, or the microphones may be physically separate, or the microphones may be formed as one unit. The invention also relates to a mask having at least two microphones.

BRIEF DESCRIPTION OF THE DRAWINGS

The foregoing and other features of the present invention will become apparent to one skilled in the art to which the present invention relates upon consideration of the following description of the invention with reference to the accompanying drawings, in which.

DETAILED DESCRIPTION OF THE INVENTION

Figure 2:
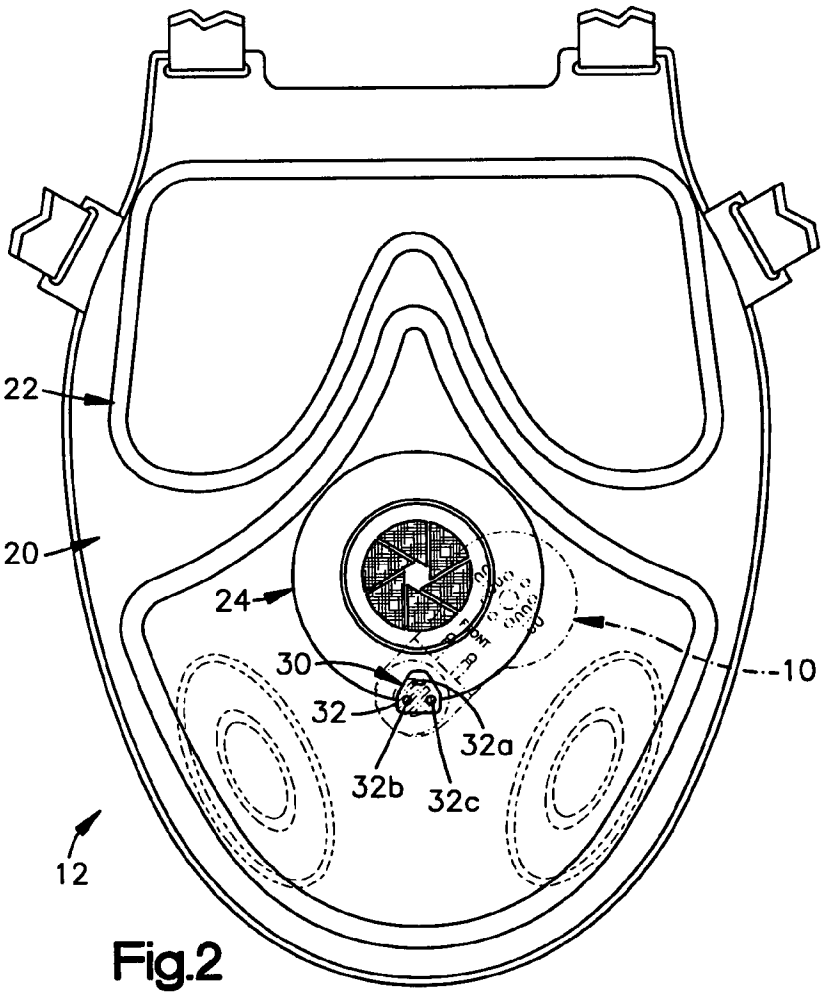
FIG. 2 is a schematic back (inside) elevational view of the mask of FIG. 1 including a microphone assembly in accordance with a first embodiment of the present invention.
Figure 1:
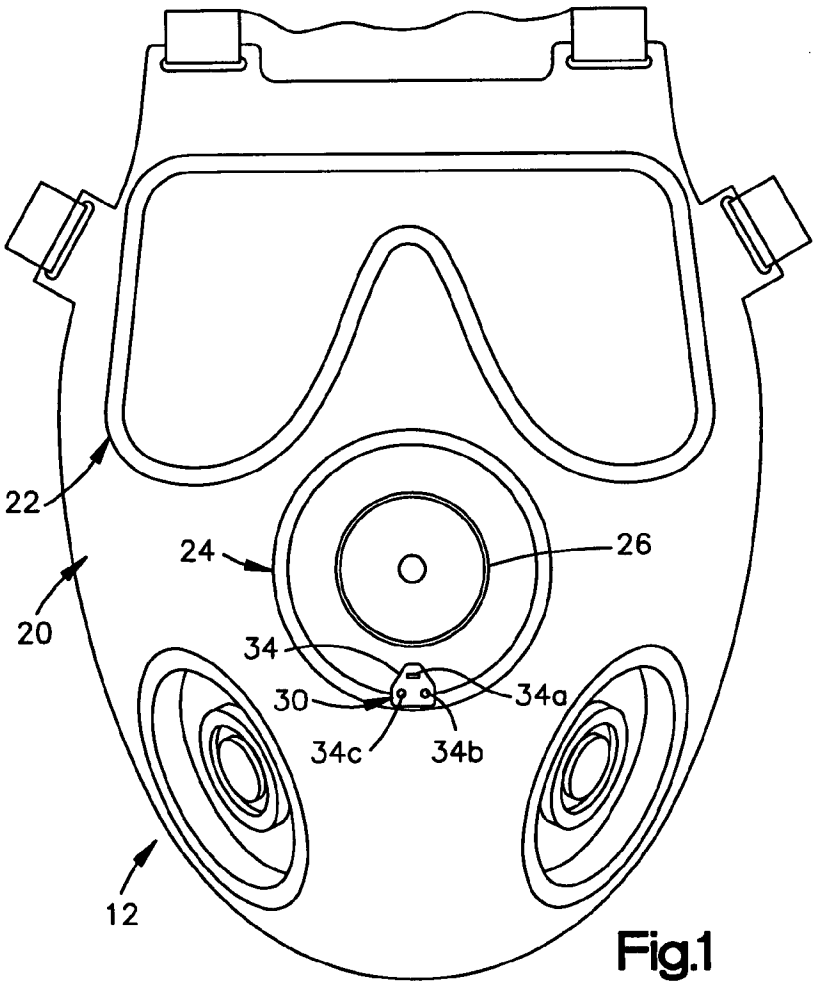
FIG. 1 is a schematic front (outside) elevational view of a mask.
Figure 3:
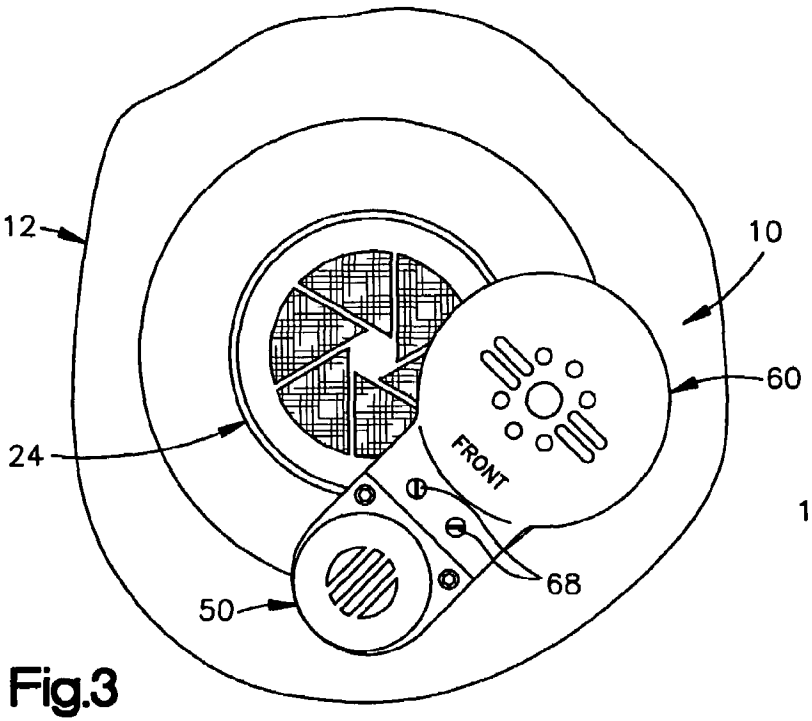
FIG. 3 is an enlarged view of the microphone assembly of FIG. 1 shown supported on the inside of the mask.
Figure 4:
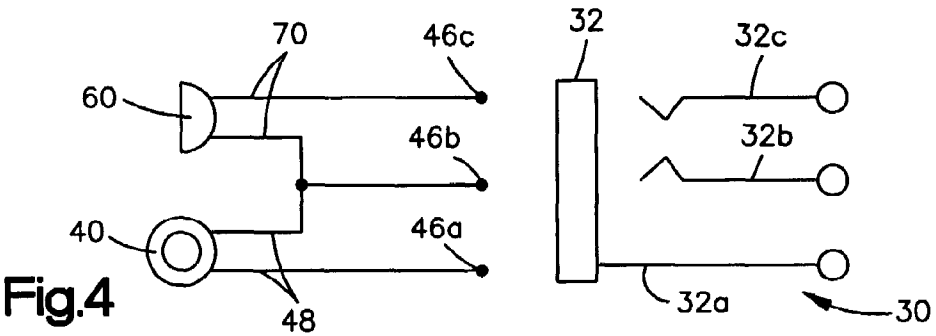
FIG. 4 is an electrical schematic diagram of the microphone assembly of FIG. 1.
Figure 5:
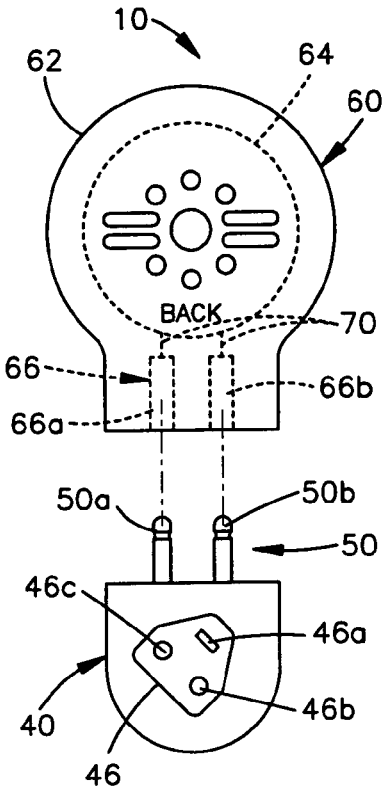
FIG. 5 is a back elevational view of the microphone assembly of FIG. 1, showing the two microphones separated from each other.

The present invention relates to a microphone assembly for a mask. In particular, the present invention relates to a microphone assembly including two microphones, usable in connection with a mask such as is worn by a firefighter or soldier for protection and breathing. The present invention is applicable to and may be embodied in various different microphone and mask constructions. As representative of the invention, FIGS. 2-11 illustrate a microphone assembly 10 in accordance with a first embodiment of the invention. The microphone assembly 10 is shown in use with a mask 12 (FIGS. 1-3).

The mask 12 includes a body 20. The mask body 20 is typically molded from a rubber-type material. As a result, the mask body 20 is flexible to fit over and adapt to the configuration of the user's face. The mask 12 includes a viewing window 22 set in the mask body 20. The viewing window 22 is located in front of the user's eyes when the mask 12 is in place.

It should be understood that the term "mask" or "face mask" or the like, as used herein, is intended to include (at least, and not limited to) any device that covers a wearer's mouth, for example, a helmet, a full face mask, a partial face mask, etc.

The mask 12 includes an air supply portal 24. The air supply portal 24 provides an air supply passage between the interior of the mask 12 and the exterior of the mask. The air supply portal 24 has an external connector 26 that is adapted to receive an air supply connection (not shown), such as an oxygen tube or similar device or filtered air.

The mask 12 includes a communications pass-through 30. The pass-through 30 is a portion of the mask 12 that provides a multi-conductor electrical connection between the interior of the mask and the exterior of the mask. In the illustrated embodiment, the pass-through 30 is located adjacent the air supply portal 24 and thus adjacent a user's mouth. The pass-through 30 could be located elsewhere on a mask, in other embodiments of the invention.

The pass-through 30 has an inner end portion 32 and an outer end portion 34. The inner end portion 32 has three pin openings 32*a*, 32*b* and 32*c* that are arranged in a particular pattern. The outer end portion 34 also has three pin openings 34*a*, 34*b*, and 34*c* that are arranged in the same pattern. The pass-through 30 has three conductors (not shown) extending between the inner end portion 32 and the outer end portion 34. The three conductors provide electrical connection between the internal pin openings 32*a*-32*c* and the external pin openings 34*a*-34*c* of the pass-through 30. Other pass-throughs could have more than three conductors or fewer than three conductors.

The pass-through 30 is used for directing the output signal of one or more microphones, located on the interior of the mask 12, to a location external of the mask. A radio unit (not shown), intercom, telephone, a voice projection unit, or any other communication device that needs a microphone signal to bring the user's voice outside the mask, can be connected to the outer end portion 34 of the pass-through 30.

Figure 6:
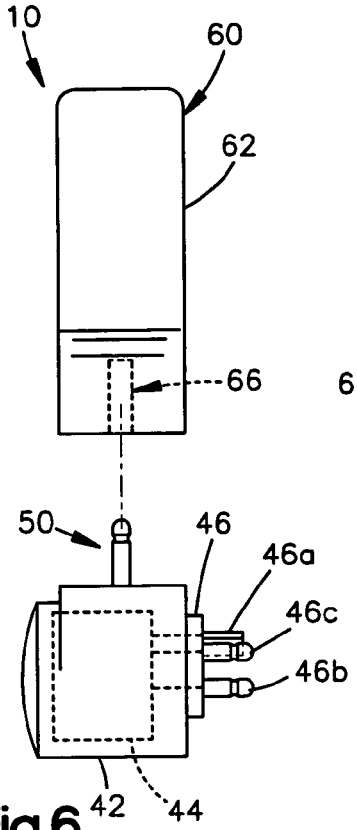
FIG. 6 is a side elevational view of the microphone assembly of FIG. 1, showing the two microphones separated from each other.
Figure 7:
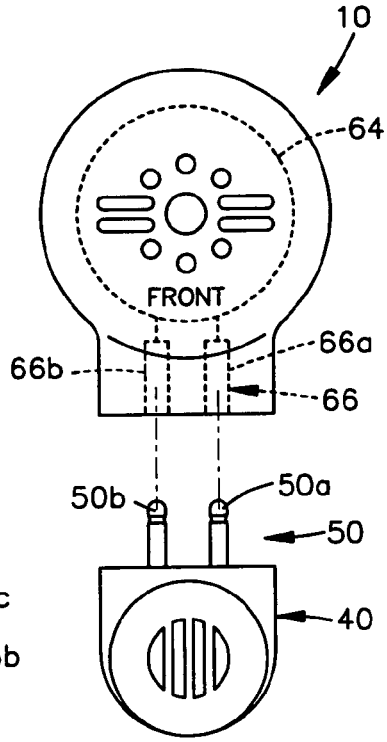
FIG. 7 is a front elevational view of the microphone assembly of FIG. 1, showing the two microphones separated from each other.
Figure 8:
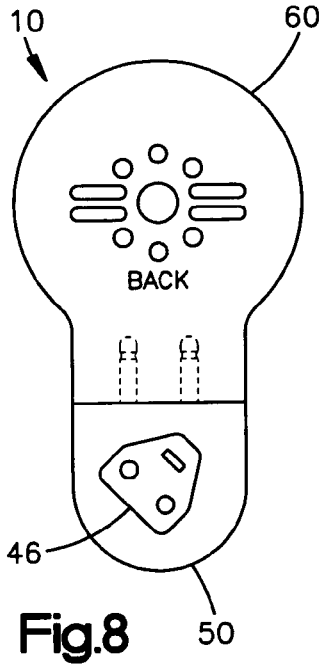
FIG. 8 is a back elevational view of the microphone assembly of FIG. 1, showing the two microphones assembled to each other.
Figure 9:
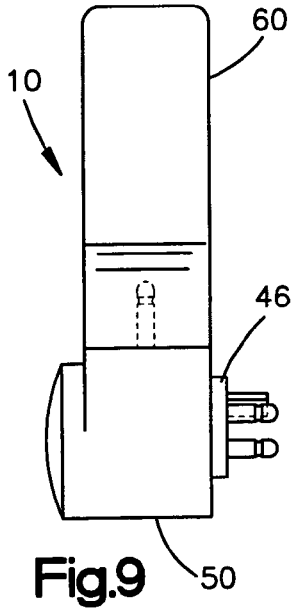
FIG. 9 is a side elevational view of the microphone assembly of FIG. 1, showing the two microphones assembled to each other.
Figure 10:
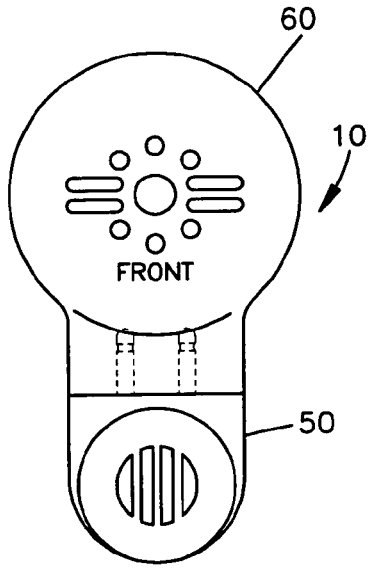
FIG. 10 is a front elevational view of the microphone assembly of FIG. 1, showing the two microphones assembled to each other.

The microphone assembly 10 includes a first microphone 40 and a second microphone 60. The first microphone 40, in the illustrated embodiment, is a powered, or electret, microphone that is for use with a voice projection unit. The first microphone 40 has a body portion 42 that encloses a transducer shown schematically at 44 (FIG. 6).

The first microphone 40 also includes an electrical connector 46. The connector 46 has three projecting output pins 46*a*, 46*b*, and 46*c* that are arranged in a pattern that is identical to the pattern of the pin openings 32*a*-32*c* in the inner end portion 32 of the pass-through 30. Two conductors shown schematically at 48 extend between and electrically interconnect the transducer 44 and two of the three output pins, a first pin 46*a* and a common pin 46*b*.

The first microphone 40 also has a support portion 50. The support portion 50 of the first microphone 40 is adapted to support the second microphone 60, as described below. The support portion 50 in the illustrated embodiment includes two projecting metal pins 50*a* and 50*b*. The pins 50*a* and 50*b* of the support portion 50 are electrically connected inside the first microphone 40, in a manner not shown, with the second pin 46*c* and the common pin 46*b* of the connector 46.

The second microphone 60, in the illustrated embodiment, is for use with the radio unit and is a non-powered, or dynamic, microphone. The second microphone 60 has a body portion 62 that encloses a transducer shown schematically at 64.

The second microphone 60 also includes an electrical connector 66. The connector includes two metal sleeves 66*a* and 66*b* that are arranged in a pattern identical to the pattern of the two projecting pins 50*a* and 50*b* on the support portion 50 of the first microphone 40. The connector 66 on the second microphone 60 includes two set screws 68 (FIG. 3) that are movable transversely into the openings of the sleeves 66*a* and 66*b*. Two conductors shown schematically at 70 extend between and electrically interconnect the transducer 64 and the sleeves 66*a* and 66-*b*.

The second microphone 60 is electrically and mechanically connectable with the first microphone 40 to form a single, modular unit 10 that is usable with the single, three-conductor pass-through 30. To connect the two microphones, the two pins 50*a* and 50*b* of the first microphone 40 are received in the two sleeves 66*a* and 66*b*, respectively, of the second microphone 60. The engagement of the pins 50*a* and 50*b* in the sleeves 66*a* and 66*b* establishes an electrical connection between the second microphone 60 and the first microphone 40.

As a result, there is an electrical connection between the transducer 64 of the second microphone 60 and the second pin 46*c* and the common pin 46*b*, through the first microphone 50. Thus, the output signal of the second microphone 60 is present at the output pins 46*b* and 46*c*. At the same time, the output signal of the first microphone is present at the output pins 46*a* and 46*b*.

The set screws 68 of the connector 66 of the second microphone 60 can be tightened down on the pins 50*a* and 50*b*, to help secure the second microphone mechanically to the first microphone 40.

The assembly 10 of the first microphone 40 and the second microphone 60 is supported as one unit on the mask 12. Specifically, the assembly 10 of the first microphone 40 and the second microphone 60 is supported on the inner end portion 32 of the pass-through 30. The three output pins 46*a*-46*c* of the first microphone 40 engage in the three pin openings 32*a*-32*c*, respectively, of the inner end portion 32 of the pass-through 30. As a result, the output signal of the first microphone 40 is electrically connected with the pass-through 30. The first microphone 40 is also mechanically supported on the pass-through 30.

Because the second microphone 60 is mechanically supported on the first microphone 40, the second microphone is also mechanically supported on the pass-through 30. Because the second microphone 60 is electrically connected with the three output pins 46*a*-*c* of the first microphone 40, the output signal of the second microphone also is electrically connected with the pass-through 30. Thus, a separate electrical connection for the second microphone 60 is not needed, as it is piggy backed on the electrical connection for the first microphone 40. Both the first microphone 40 and the second microphone 60 are active at all times.

Because the microphone assembly 10 is a modular unit, different microphone combinations are possible. For example, the invention could be embodied in a microphone assembly 10 that includes a dynamic microphone that supports a powered microphone. The invention could be embodied in a microphone assembly 10 that includes two of the same kind of microphone—for example, a powered microphone that supports another powered microphone, or a non-powered microphone that supports another non-powered microphone. One of the microphones could be a bone-conducting microphone, which uses an accelerometer to convert bone vibration resulting form voice, into an electric signal. The invention could also be embodied in a microphone assembly 10 that includes more than two microphones.

Figure 11:
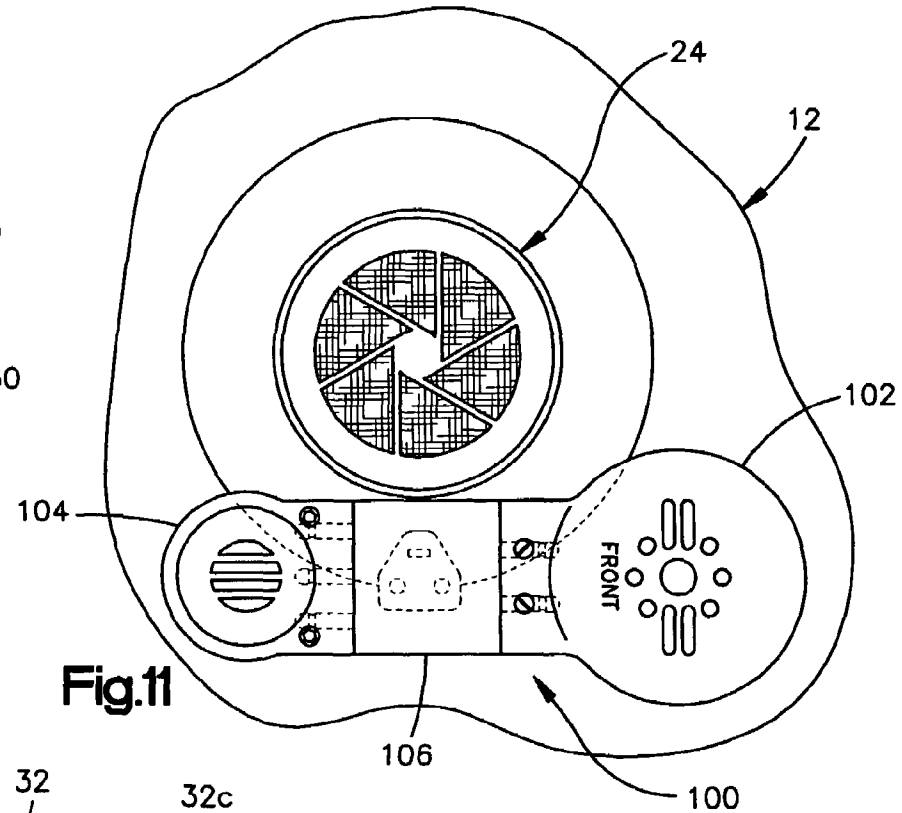
FIG. 11 is a view similar to FIG. 3 showing a microphone assembly in accordance with a second embodiment of the present invention.

In addition, the invention could also be embodied in a microphone assembly that includes a single electrical connector that plugs into the mask 12, and from which two microphones are supported electrically and mechanically. Such a microphone assembly 100 is shown in FIG. 11. The microphone assembly 100 includes a first microphone 102 and a second microphone 104. The microphone assembly 100 also includes a base 106. The base 106 supports the first and second microphones 102 and 104 mechanically on the pass-through 30 (not shown in FIG. 11) of the mask 12. The base 106 also serves as an electrical connector that electrically connects both the first microphone 102 and the second microphone 104 with the pass-through 30.

Figure 12:
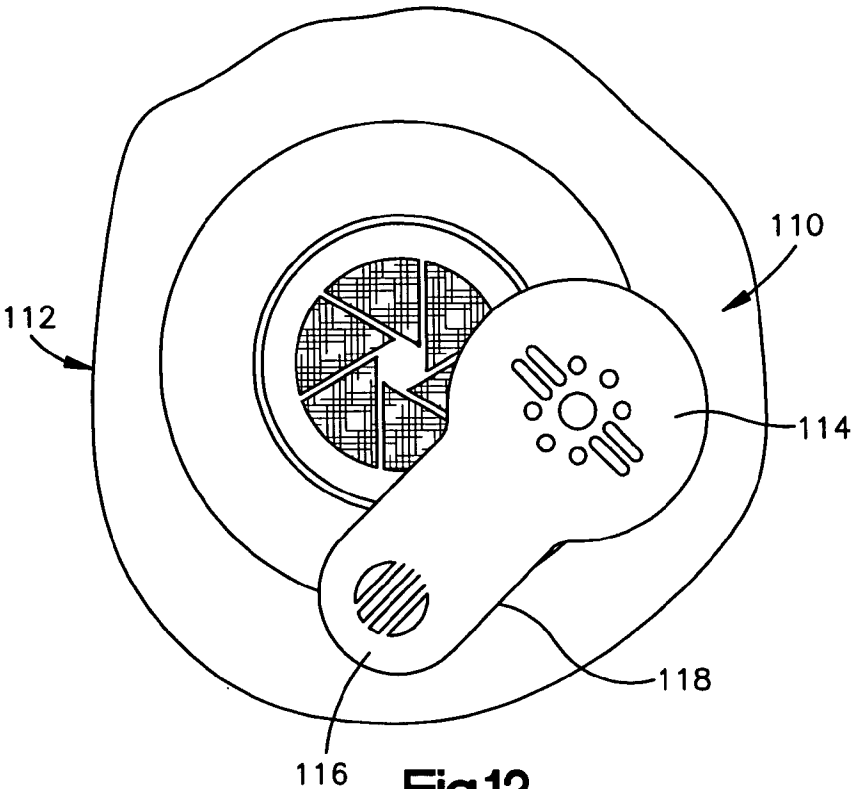
FIG.12 is a view similar to FIG.3 showing a microphone assembly mounted on a mask; and, FIG.13 is a schematic front (outside) elevational view of a mask that includes a first microphone and a second microphone that are not physically joined but are instead mounted at spaced apart locations on the mask.

In addition, the invention could be embodied in a microphone assembly that includes two individual microphones that are permanently assembled to each other. Alternatively, the invention could be embodied in a microphone assembly that is formed as one unit with two individual transducers in it (as opposed to being two individual microphones that are permanently assembled to each other). This is illustrated in FIG. 12 which shows a microphone assembly 110 mounted on a mask 112. The microphone assembly 110 includes a first microphone 114 and a second microphone 116. The two microphones 114 and 116 are mounted or installed in a single package or housing 118.

Figure 13:
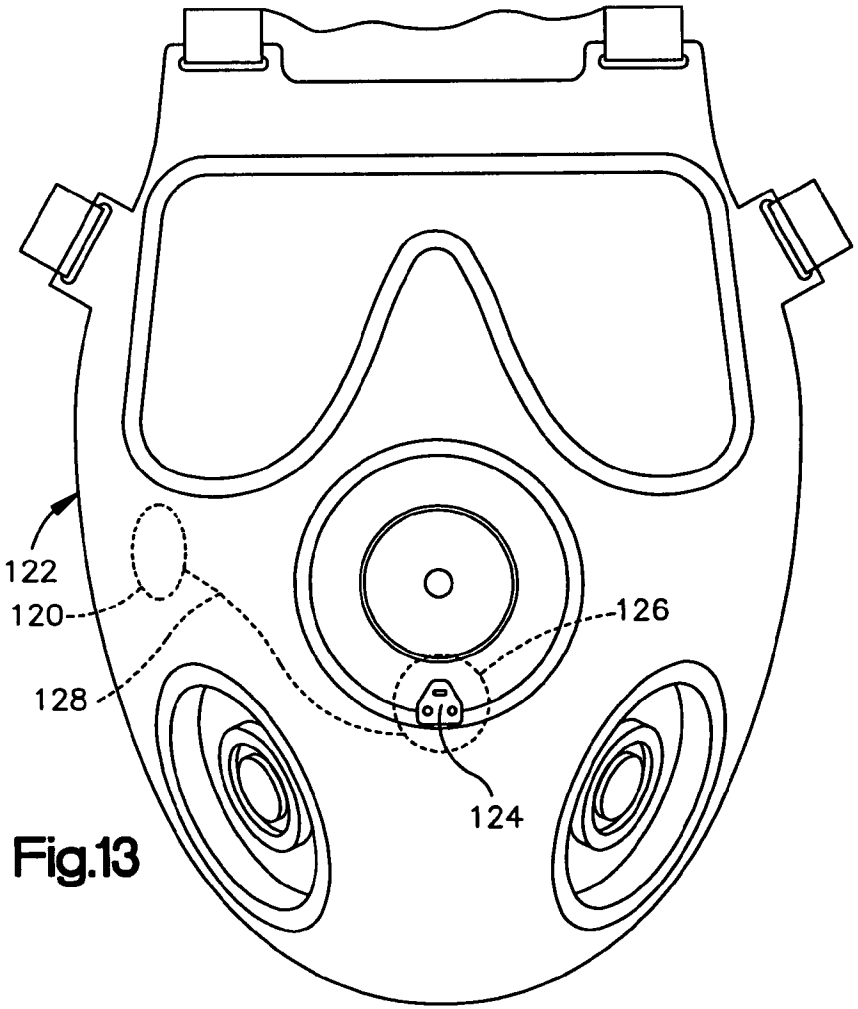

FIG. 13 illustrates a further embodiment of the invention in which the two microphones are not physically joined but are instead mounted at spaced apart locations on the mask. A first microphone 120 is mounted on the mask 122 at a location spaced apart from a pass-through 124. A second microphone 126 is mounted on the pass-through 124. The second microphone 126 could, alternatively, be mounted off the pass-through 124, like the first microphone 120.

The first microphone 120 and the second microphone 126 are connected by wiring indicated schematically at 128. Thus, the two microphones 120 and 126 share a common pass-through 124. As noted above, the pass-through 124 could be located elsewhere on the mask 122 than as shown.

From the above description of the invention, those skilled in the art will perceive improvements, changes, and modifications in the invention. Such improvements, changes, and modifications within the skill of the art are intended to be included within the scope of the appended claims.

Having described the invention, we claim:

1. A microphone assembly for a face mask having a pass-through comprising a first microphone electrically connected with said pass-through and a second microphone electrically connected with said pass-through, said pass-through being a multi-conductor pass-through, at least one of said first microphone and said second microphone being at least partially supported on said pass-through, said first microphone at least partially supporting said second microphone, said first microphone having a multi-conductor electrical connector that engages and at least partially supports said first microphone on said pass-through, said second microphone being at least partially supported on said first microphone by at least two additional conductors that are electrically connected with two of said conductors of said multi-conductor electrical connector, said second microphone being a two-conductor microphone whose output is transmitted through said multi-conductor connector to said pass-through.

2. The microphone assembly as set forth in claim 1, wherein only one of said first and second microphones is supported on said pass-through.

3. The microphone assembly as set forth in claim 1, wherein one of said first and said second microphones is an electret microphone and the other one of said first and second microphones is a dynamic microphone.

4. A mask comprising a pass-through and a microphone assembly, said pass-through designed to pass a signal from an interior to an exterior of the mask through a plurality of electrical connections, said microphone assembly at least partially mounted on an interior of said mask, said microphone assembly including a first microphone arrangement and a second microphone arrangement, each of said microphone arrangements including first and second electrical connectors designed to be electrically connected to at least one electrical connection of said pass-through such that at least one signal passes from an exterior of said mask to an interior of said mask, from an interior of said mask to an exterior of said mask, or combinations thereof, each of said microphone arrangements including at least one microphone, at least one of said first microphone arrangement and said second microphone arrangement are detachably connected to said pass-through, said first microphone arrangement is releasably connected to said second microphone arrangement.

5. The mask as defined in claim 4, wherein at least one of said electrical connectors of said first microphone arrangement is connected to an electrical connection of the pass-through that is not electrically connected to any electrical connector of said second microphone arrangement.

6. The mask as defined in claim 5, wherein said first and second microphone assemblies are mounted on an interior of said mask.

7. The mask as defined in claim 6, wherein said first and second microphone assemblies each include at least one electrical connector that is designed to be electrically connected to the same electrical connection of said pass-through.

8. The mask as defined in claim 7, wherein at least one of said first and second microphone assemblies are designed to be at least partially supported on said pass-through.

9. The mask as defined in claim 8, wherein both said first and second microphone assemblies are at least partially supported on said pass-through.

10. The mask as defined in claim 9, wherein said first microphone arrangement at least partially supports said second microphone arrangement on said mask when said first microphone arrangement is at least partially connected to said pass-through.

11. The mask as defined in claim 10, wherein said first microphone arrangement is electrically connected to a device selected from the group consisting of an intercom, a telephone, a radio unit, or a voice projection unit; said second microphone arrangement electrically connected to a device different from the device connected to said first microphone arrangement.

12. The mask as defined in claim 11, wherein said first microphone arrangement and said second microphone arrangement include different types of microphones.

13. The mask as defined in claim 12, including an external microphone located on an exterior of said mask, said pass-through designed to pass a signal from said external microphone to said microphone assembly.

14. The mask as defined in claim 13, wherein said pass-through is located adjacent an air supply portal in said mask.

15. The mask as defined in claim 14, wherein at least one of said first microphone arrangement and said second microphone arrangement are detachably connected to said pass-through.

16. The mask as defined in claim 8, including an external microphone located on an exterior of said mask, said pass-through designed to pass a signal from said external microphone to said microphone assembly.

17. The mask as defined in claim 8, wherein said first microphone arrangement is electrically connected to a device selected from the group consisting of an intercom, a telephone, a radio unit, or a voice projection unit; said second microphone arrangement electrically connected to a device different from the device connected to said first microphone arrangement.

18. The mask as defined in claim 17, wherein said first microphone arrangement and said second microphone arrangement include different types of microphones.

19. The mask as defined in claim 4, wherein said first and second microphone assemblies are mounted on an interior of said mask.

20. The mask as defined in claim 4, wherein said first and second microphone assemblies each include at least one electrical connector that is designed to be electrically connected to the same electrical connection of said pass-through.

21. The mask as defined in claim 4, wherein at least one of said first and second microphone assemblies are designed to be at least partially supported on said pass-through.

22. The mask as defined in claim 21, wherein both said first and second microphone assemblies are at least partially supported on said pass-through.

23. The mask as defined in claim 22, wherein said first microphone arrangement at least partially supports said second microphone arrangement on said mask when said first microphone arrangement is at least partially connected to said pass-through.

24. The mask as defined in claim 4, wherein said first microphone arrangement at least partially supports said second microphone arrangement on said mask when said first microphone arrangement is at least partially connected to said pass-through.

25. The mask as defined in claim 4, wherein said first microphone arrangement is electrically connected to a device selected from the group consisting of an intercom, a telephone, a radio unit, or a voice projection unit; said second microphone arrangement electrically connected to a device different from the device connected to said first microphone arrangement.

26. The mask as defined in claim 25, wherein said first microphone arrangement and said second microphone arrangement include different types of microphones.

27. The mask as defined in claim 4, including an external microphone located on an exterior of said mask, said pass-through designed to pass a signal from said external microphone to said microphone assembly.

28. The mask as defined in claim 4, wherein said pass-through is located adjacent an air supply portal in said mask.

* * * * *